US010934926B2

(12) United States Patent
Steiner et al.

(10) Patent No.: US 10,934,926 B2
(45) Date of Patent: Mar. 2, 2021

(54) COOLING SYSTEM OF AN INTERNAL COMBUSTION ENGINE OF A MOTOR VEHICLE

(71) Applicant: Ford Global Technologies, LLC, Dearborn, MI (US)

(72) Inventors: Bernd Steiner, Bergisch Gladbach (DE); Jan Mehring, Cologne (DE); Helmut Hans Ruhland, Eschweiler (DE); Bernd Brinkmann, Dormagen (DE)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 16/557,714

(22) Filed: Aug. 30, 2019

(65) Prior Publication Data

US 2020/0072119 A1 Mar. 5, 2020

(30) Foreign Application Priority Data

Sep. 3, 2018 (DE) ..... 102018214899.6

(51) Int. Cl.

| | |
|---|---|
| ***F01P 11/02*** | (2006.01) |
| ***F01P 3/18*** | (2006.01) |
| ***F01M 1/02*** | (2006.01) |
| ***F01P 5/10*** | (2006.01) |
| ***F02B 37/00*** | (2006.01) |
| ***F01M 1/16*** | (2006.01) |
| *F01P 7/14* | (2006.01) |

(52) U.S. Cl.

CPC ..... *F01P 11/029* (2013.01); *F01M 1/02* (2013.01); *F01M 1/16* (2013.01); *F01P 3/18* (2013.01); *F01P 5/10* (2013.01); *F02B 37/00* (2013.01); *F01M 2001/0215* (2013.01); *F01P 2003/182* (2013.01); *F01P 2007/143* (2013.01); *F01P 2007/146* (2013.01)

(58) Field of Classification Search

CPC .. F01P 11/029; F01P 7/16; F01P 11/18; F01P 11/02; F01P 2060/08; F01P 7/026

See application file for complete search history.

(56) References Cited

U.S. PATENT DOCUMENTS 5,730,089 A * 3/1998 Morikawa ..... B60H 1/00885 123/41.14

6,532,910 B2 3/2003 Langervik (Continued)

FOREIGN PATENT DOCUMENTS

DE 2221388 A1 11/1972

DE 10138083 A1 2/2003

(Continued)

*Primary Examiner* — Long T Tran

(74) *Attorney, Agent, or Firm* — Geoffrey Brumbaugh; McCoy Russell LLP

(57) ABSTRACT

An internal combustion engine of a motor vehicle is provided. The internal combustion engine includes a coolant, a liquid/gas heat exchanger, a coolant-temperature-dependent control element, an equalizing tank, fluidic connections between the components, and a coolant pump. At least one direct or at least one activation-dependent fluidic connection or at least one force-transmitting connection is set up between a medium in the equalizing tank and a medium of at least one other media path or media circuit of the motor vehicle.

15 Claims, 11 Drawing Sheets

(56) References Cited

U.S. PATENT DOCUMENTS

| | | | | |
|---|---|---|---|---|
| 7,222,495 | B2 | 5/2007 | Bruzzo | |
| 8,065,980 | B2 | 11/2011 | Dahl et al. | |
| 8,794,193 | B2 | 8/2014 | Kraki et al. | |
| 9,140,176 | B2 | 9/2015 | Steiner et al. | |
| 9,458,759 | B2 | 10/2016 | Rollinger et al. | |
| 9,719,409 | B2 | 8/2017 | Rollinger et al. | |
| 9,726,069 | B2 | 8/2017 | Styron et al. | |
| 2005/0229873 | A1* | 10/2005 | Willers | F02N 19/10 123/41.14 |
| 2010/0050960 | A1* | 3/2010 | Araki | F01P 7/165 123/41.1 |
| 2011/0308484 | A1 | 12/2011 | Peterson et al. | |
| 2015/0345365 | A1 | 12/2015 | Wikström | |
| 2016/0186645 | A1 | 6/2016 | Rollinger et al. | |
| 2016/0186648 | A1* | 6/2016 | Rollinger | B60W 10/00 123/41.15 |
| 2016/0186649 | A1 | 6/2016 | Rollinger et al. | |

FOREIGN PATENT DOCUMENTS

| | | | |
|---|---|---|---|
| DE | 102006019086 | A1 | 10/2007 |
| DE | 102015100832 | A1 | 7/2015 |
| GB | 1351900 | A | 5/1974 |

* cited by examiner

| | 1000 | 1250 | 1500 | 1750 | 2000 | 2250 | 2500 | 3000 | 3500 | 4000 | 4500 | 5000 | 5500 | 6000 |
|---|---|---|---|---|---|---|---|---|---|---|---|---|---|---|
| FL | 1301 | 1584 | 1970 | 1870 | 2358 | 2395 | 2434 | 2274 | 2479 | 2240 | 2279 | 2469 | 2297 | 2163 |
| 200 | | | | | 2298 | 2289 | 2347 | 2456 | 2482 | | | | | |
| 190 | | | | 2104 | 2170 | 2164 | 2203 | 2263 | 2321 | | | | | |
| 180 | | | 1992 | 1980 | 2035 | 2027 | 2043 | 2121 | 2174 | 2242 | | | | |
| 170 | | | 1900 | 1859 | 1911 | 1886 | 1892 | 1969 | 2028 | 2105 | 2171 | 2452 | | |
| 160 | | | 1770 | 1733 | 1779 | 1747 | 1765 | 1817 | 1865 | 1931 | 1980 | 2210 | 2319 | |
| 150 | | | 1664 | 1625 | 1627 | 1603 | 1612 | 1673 | 1715 | 1761 | 1812 | 1940 | 2131 | 2155 |
| 140 | | 1573 | 1550 | 1501 | 1510 | 1492 | 1484 | 1527 | 1577 | 1616 | 1657 | 1752 | 1831 | 1966 |
| 130 | | 1470 | 1408 | 1371 | 1374 | 1368 | 1370 | 1406 | 1439 | 1471 | 1501 | 1605 | 1652 | 1742 |
| 120 | | 1359 | 1309 | 1268 | 1332 | 1291 | 1285 | 1320 | 1354 | 1391 | 1391 | 1444 | 1524 | 1549 |
| 110 | 1289 | 1259 | 1225 | 1235 | 1249 | 1216 | 1213 | 1236 | 1275 | 1299 | 1320 | 1341 | 1388 | 1421 |
| 100 | 1177 | 1175 | 1174 | 1151 | 1158 | 1122 | 1134 | 1109 | 1138 | 1157 | 1177 | 1193 | 1296 | 1349 |
| 90 | 1109 | 1092 | 1081 | 1119 | 1114 | 1084 | 1085 | 1102 | 1121 | 1141 | 1154 | 1164 | 1169 | 1246 |
| 80 | 1066 | 1044 | 1039 | 1051 | 1075 | 1077 | 1076 | 1093 | 1108 | 1137 | 1151 | 1157 | 1160 | 1151 |
| 70 | 1021 | 1025 | 1034 | 1045 | 1067 | 1066 | 1047 | 1064 | 1090 | 1113 | 1129 | 1142 | 1147 | 1146 |
| 60 | 1017 | 1019 | 1028 | 1037 | 1051 | 1042 | 1044 | 1051 | 1054 | 1061 | 1062 | 1067 | 1064 | 1062 |
| 50 | 1013 | 1015 | 1019 | 1024 | 1038 | 1036 | 1040 | 1046 | 1049 | 1054 | 1053 | 1059 | 1056 | 1057 |
| 40 | 1023 | 1032 | 1015 | 1021 | 1034 | 1033 | 1036 | 1041 | 1043 | 1049 | 1047 | 1052 | 1048 | 1050 |
| 30 | 1018 | 1024 | 1014 | 1017 | 1028 | 1027 | 1031 | 1036 | 1038 | 1041 | 1042 | 1045 | 1040 | 1042 |
| 20 | 1014 | 1017 | 1025 | 1015 | 1028 | 1027 | 1028 | 1030 | 1032 | 1033 | 1033 | 1035 | 1035 | 1036 |
| 10 | 1014 | 1014 | 1014 | 1015 | 1028 | 1026 | 1027 | 1029 | 1032 | 1039 | 1035 | 1033 | 1030 | 1030 |
| 5 | 1014 | 1014 | 1014 | 1018 | 1030 | 1027 | 1030 | 1030 | 1042 | 1058 | 1059 | 1052 | 1043 | 1041 |
| 2 | 1014 | 1014 | 1017 | 1021 | 1034 | 1034 | 1046 | 1058 | 1063 | 1091 | 1100 | 1093 | 1061 | 1062 |

FIG. 10

COOLING SYSTEM OF AN INTERNAL COMBUSTION ENGINE OF A MOTOR VEHICLE

CROSS-REFERENCE TO RELATED APPLICATION

The present application claims priority to German Patent Application No. 102018214899.6, filed Sep. 3, 2018. The entire contents of the above-listed application are hereby incorporated by reference for all purposes.

FIELD

The present description relates generally to methods and systems for regulating pressure in a cooling system of an internal combustion engine of a motor vehicle.

BACKGROUND/SUMMARY

In the field of motor-vehicle technology, it is known to use various media paths and media circuits to ensure safe and sustainable operation of an internal combustion engine of a motor vehicle.

A widely used cooling system uses a liquid coolant as a medium for discharging heat produced during operation of an internal combustion engine of a motor vehicle to the surroundings.

For example, a motor vehicle can have an engine-cooling system for transmitting the process heat produced during operation of the internal combustion engine to the outside air. The engine-cooling system is provided to reach an operating temperature of the internal combustion engine as quickly as possible, to maintain the operating temperature, and to prevent overheating of the internal combustion engine. A coolant which is frequently used in this process may contain, for example, a water/glycol mixture having additives to prevent corrosion inside the engine-cooling system. The engine-cooling system can contain, for example, an equalizing tank for receiving the coolant which has different volumes as a result of the thermal expansion at different operating temperatures. If the temperature of the coolant inside the engine-cooling system increases, the thermal expansion of the coolant in the equalizing tank causes an increase in pressure, since the air volume enclosed therein decreases. A pressure equalization can be achieved by releasing air from the equalizing tank through a valve. If the temperature and the pressure of the coolant in the equalizing tank drop below the atmospheric air pressure, air can be sucked into the equalizing tank through another valve.

The engine-cooling system can further comprise a liquid/gas heat exchanger, which is conventionally referred to as a cooler, and which is provided to transmit heat from the coolant flowing through a cavity of the cooler to the outside air, for example to an air stream flowing through. A thermostatic valve can be arranged directly on the cooler, which valve, according to a temperature of the coolant, produces a coolant path which, above a predetermined coolant temperature, switches from a small coolant circuit at a low coolant temperature, which circuit contains a coolant pump and at least part of the engine block, to a large coolant circuit which additionally includes the cooler and the equalizing tank.

Another media circuit is the oil lubrication in which lubricating oil is used as a medium. In the case of the known wet-sump lubrication, an oil sump arranged underneath a crankcase is used to receive a lubricant supply. An oil pump conveys the lubricating oil from the oil sump through an oil filter and provided channels to the crankshaft, in particular to the lower connecting rod bearings. For example, by moving the crankshaft, the lubricating oil can reach the upper connecting rod bearings and the lower faces of the cylinder pistons, from where said oil can flow back into the oil sump.

To prevent overheating of an internal combustion engine in operation, a predetermined minimum amount of coolant in a cooling system is to be used. To monitor an amount of coolant, various proposals are known in the prior art.

For example, U.S. Pat. No. 9,726,069 B2 describes methods and systems which improve estimation of engine coolant levels to reduce the risk of engine overheating. The liquid level in a coolant overflow reservoir is deduced based on a liquid level in a hollow vertical standpipe which is fluidically coupled to the reservoir at upper and lower points. An ultrasound sensor which is positioned in a recess at the bottom of the vertical standpipe transmits signals in an intermittent manner, receives the echoes thereof after said signals are reflected by the surface of the coolant, and estimates the liquid level in the standpipe based on echo times.

US 2016/0186645 A1 additionally proposes, in one development of the methods and systems from U.S. Pat. No. 9,726,069 B2, compensating for the sensor output signal with a variable which is based on vehicle movement parameters to compensate for a distortion of the liquid level as a result of movement-induced sloshing.

Since, as a result of the non-linear saturation vapor pressure curve thereof, the vapor pressure of a water-containing coolant noticeably increases only shortly before reaching the operating temperature of the internal combustion engine, in particular when starting the engine with cold coolant, there is a risk of cavitation inside the coolant pump, which can result in a shortened service life of the coolant pump.

To solve this problem, U.S. Pat. No. 8,065,980 B2 proposes for example an engine-cooling system which is provided with a cooling circuit which contains a coolant pump for supplying an engine with a coolant and for circulating the coolant in the cooling circuit. Downstream of the engine, the cooling circuit has at least one heat exchanger for cooling the coolant, an expansion tank connected to the cooling circuit upstream of the coolant pump. The cooling system is placed under pressure by a pressure-regulating means, which is provided to pressurize a coolant which is supplied to the cooling circuit from the expansion tank during at least one predetermined operating mode of the engine. The pressure-regulating means can be a controllable pump or an injector which is arranged to supply pressurized coolant to the coolant pump in the cooling circuit. This arrangement can be used to prevent cavitation in the coolant pump during specific operating conditions, such as starting the engine with cold coolant. During all normal engine operating modes, the expansion tank is closed with respect to the ambient atmosphere.

Furthermore, US 2015/0345365 A1 discloses an arrangement and a method for placing a cooling system under pressure, which system cools the internal combustion engine in a motor vehicle. The cooling system comprises a coolant pump for circulating the coolant in the cooling system, an expansion tank, which allows the coolant in the cooling system to expand, and a pressure relief valve which releases air at a specific pressure inside the cooling system. A compressed-air supply device which is under pressure makes it possible to supply compressed air to the cooling system by supplying a continuous airflow to the cooling system while the internal combustion engine is in operation and makes it possible to supply an airflow of a size which corresponds at least to the estimated leakage of the cooling system. As a result, cavitation in the coolant pump while starting the engine with cold coolant can be prevented.

To reach an operating temperature of the internal combustion engine as quickly as possible, in some engine-cooling systems, the coolant is circulated only when a preset minimum temperature is reached. This can lead to considerable material stresses when too small an amount of coolant is introduced into the cooler after reaching the preset minimum temperature, which can lead to a non-uniform coolant flow inside the cooler.

As a remedy for this, U.S. Pat. No. 8,794,193 B2 describes a device for cooling an internal combustion engine, in which the circulation of cooling water is continued until the cooling water has reached a predetermined temperature, by means of which a decrease in the durability of a cooler can be prevented, which is otherwise caused by a thermal load which arises when the circulation of the cooling water is restarted, and the cooling water is introduced into the cooler. An internal combustion engine comprises an electric pump, a water temperature sensor, a cooler and a thermostat. The water temperature sensor detects a cooling water temperature. The cooler can allow the cooling water to circulate between the cooler and an engine-cooling system. When the cooling water temperature is as great as or greater than a valve-opening temperature, the thermostat opens, and the cooling water is introduced into the cooler. An electronic control device carries out a control in such a way that the outlet pressure of the cooling water is increased by the electric pump before the thermostat opens and cooling water is introduced into the cooler. It is thus possible to prevent the durability of the heat exchanger from being impaired by thermal stress as a result of a non-uniform flow, while local boiling of the cooling water is simultaneously prevented. Another important prerequisite for an effective discharge of heat produced during operation of an internal combustion engine of a motor vehicle to the surroundings is preventing vapor bubbles inside the coolant, for example in cooling channels arranged inside the cylinder head. This can be brought about by an increase in an operating pressure inside the coolant.

For example, U.S. Pat. No. 7,222,495 B2 discloses an alternative embodiment of an engine-cooling system comprising a device for cooling and cleaning a motor vehicle which is configured to air-condition the passenger compartment of the vehicle and to cool the engine block thereof. The device contains a pump, an absorber, a high-pressure generator, a low-pressure generator, a capacitor and an evaporator. The components of the device are connected by a main pipeline which contains antifreeze. In this case, the device further contains a temperature/pressure-control valve which is arranged downstream of the engine block to maintain a constant pressure, for example 1.5 bar, and a constant temperature in the part of the cooling circuit around the engine inside the engine block. The water inside this part of the cooling circuit is thus prevented from evaporating, as a result of which it is made possible to maintain the cooling of the engine block.

The temperature in the engine compartment is stabilized by a cooling device which uses the waste heat from the engine itself. Moreover, the device air-conditions the passenger compartment while the exhaust gases are cleaned without additional fuel consumption, since the waste heat from the engine block and advantageously also the exhaust gases from the engine are used for this purpose.

U.S. Pat. No. 6,532,910 B2 describes an improved cooling system for a turbocharged internal combustion engine. The internal combustion engine is equipped with a turbocharger which applies pressure to the engine air inlet manifold. The engine is further equipped with a cooling system which contains an expansion tank. A line connects the engine air inlet manifold which is placed under pressure to the cooling system, in particular to the expansion tank, to increase the pressure in the cooling system after a cold start of the internal combustion engine, as a result of which it is possible to increase the maximum temperature which the coolant in the cooling system can reach. In the line, a flow-control valve is arranged which is in the form of a spring-loaded non-return valve and allows a flow from the engine air inlet manifold to the expansion tank. In one embodiment, a directional control valve is arranged in the line, which valve is controlled by an electronic control unit. A control algorithm for the control unit is based on selected parameters such as coolant pressure, engine load, charging-air pressure, coolant temperature, ambient temperature, ambient pressure, cooling system capacity, fan speed and operating cycle.

In view of the prior art presented, the field of cooling systems comprising a liquid coolant as a medium for discharging heat produced during operation of an internal combustion engine still has room for improvement.

The disclosure addresses the problem of providing a cooling system of an internal combustion engine of a motor vehicle which uses a coolant which is liquid in normal conditions and which decreases and/or prevents the formation of bubbles in the coolant flow as a result of evaporating coolant after a cold start of the internal combustion engine inside the cooling system. It should be noted that the features and measures individually listed in the following description can be combined in any technically expedient manner and demonstrate further embodiments of the disclosure.

The cooling system according to the disclosure of an internal combustion engine of a motor vehicle comprises:

- a predetermined amount of coolant,
- at least one liquid/gas heat exchanger,
- at least one coolant-temperature-dependent control element,
- an equalizing tank for receiving some of the coolant in a coolant-temperature-dependent manner,
- connecting elements for producing fluidic connections and
- a coolant pump.

In this case, at least one direct or at least one activation-dependent fluidic connection or at least one force-transmitting connection between a medium in the equalizing tank and a medium of at least one other media path or media circuit of the motor vehicle is set up.

As used herein, a "motor vehicle" is a car, a heavy goods vehicle, a semi-trailer or a coach. Within the meaning of the disclosure, the expression "provided for this purpose" is to be understood to be specifically programmed, configured or arranged for this purpose.

As used herein, the expression "fluidic connection" is a connection which allows a material exchange of a fluid or medium. From, the expression "activation-dependent, fluidic connection" as used herein, it is to be understood that the fluidic connection can be produced by an activation process and disconnected again when the activation is discontinued.

In this manner, the cooling system can be placed under a pressure which is increased by comparison with the normal atmospheric pressure by the equalizing tank. In particular when starting the engine with cold coolant, that is to say at a pressure which substantially corresponds to the normal atmospheric pressure, bubble formation in the coolant flow as a result of evaporating coolant can thus be decreased and/or prevented. This applies in particular to coolant systems in which, for the purpose of quickly reaching a nominal operating temperature of the internal combustion engine, a circulation of the coolant is completely or partially interrupted, such as in what are known as "split-cooling" systems, in which, in a warm-up phase of the internal combustion engine, a coolant flow in the engine block is prevented, and optionally only the outlet side of the cylinder head is cooled.

However, the cooling system according to the disclosure reduces or prevents cavitation effects in the coolant pump after a cold start of the internal combustion engine.

In some embodiments, the at least one coolant-temperature-dependent control element is in the form of a continuously adjustable valve, including, but not limited to, a thermostatic valve.

The medium in the equalizing tank can be the coolant or the air located above a liquid level of the coolant in the equalizing tank, or a combination of the air and liquid level.

It should be noted that the disclosed embodiments can be applied to existing cooling systems of multiple motor vehicles by retrofitting.

In some embodiments of the cooling system, at least one other media path or media circuit is formed by an air intake region of an internal combustion engine having engine charging. Using the pressure in the air intake region which is increased by comparison with the normal atmospheric pressure immediately after a start of the internal combustion engine, air can be conveyed into the equalizing tank, and a pressure which is increased by comparison with the normal atmospheric pressure can be applied to the cooling system via the equalizing tank.

The engine charging can be produced, for example, by a turbocharger, a compressor or a fan, without being limited thereto.

In exemplary embodiments of the cooling system, in addition to the media path of the air intake region or alone, at least one other media path or media circuit is formed by an oil lubrication circuit of the motor vehicle. In a suitable embodiment, the pressure in the oil lubrication circuit, which is increased by comparison with the normal atmospheric pressure immediately after a start of the internal combustion engine, can be transmitted to the cooling system via the equalizing tank.

In some aspects, the connection set up between a medium in the equalizing tank and the medium of at least one other media path or media circuit contains an activatable non-return valve which is permeable in the direction of the equalizing tank. In this manner, in the case of a temporary drop in the pressure in the at least one other media path or media circuit, the increased pressure in the cooling system can be maintained.

Without being limited thereto, the non-return valve can be activated by reaching a specific minimum pressure in the at least one other media path or media circuit.

In some embodiments of the cooling system, the connection set up between the medium in the equalizing tank and the medium of at least one other media path or media circuit contains an electrically controllable valve. In this manner, an increase in the pressure of the cooling system may be carried out in a flexible manner. In some aspects, the increase in the pressure of the cooling system may be automated.

In one aspect, the connection set up between the medium in the equalizing tank and the medium of at least one other media path or media circuit contains a throttle valve for flow restriction. In the case of a suitable configuration of the throttle valve, an increase in the pressure of the cooling system which has a particularly simple design may thus be achieved.

In some embodiments of the cooling system, the connection set up between the medium in the equalizing tank and the medium of at least one other media path or media circuit contains a pressure-control valve for limiting the pressure in the equalizing tank. As a result, an increase in the pressure of the cooling system to a predetermined pressure may be achieved, which may be for example lower than a triggering pressure of a conventionally set-up pressure-relief valve on an upper face of the equalizing tank, and therefore a triggering of the pressure-relief valve and a loss of coolant may be prevented.

In some aspects, the connection set up between the medium in the equalizing tank and the medium of at least one other media path or media circuit contains a pressure intensifier. In this manner, when the pressure in the at least one other media path or media circuit is the same, a greater increase in the pressure in the cooling system can be achieved, as a result of which the operational safety of the cooling system with respect to preventing bubble formation as a result of boiling coolant and preventing cavitation in the coolant pump may be increased.

In further embodiments, the connection set up between the medium in the equalizing tank and the medium of at least one other media path or media circuit contains a pressure-transmission element having media separation or a fluid separator having a movable dividing wall or having a membrane. As a result, an increase in the pressure in the cooling system may be achieved without mixing the materials of the media involved.

In one embodiment of the cooling system in which at least one other media path or media circuit is formed by the oil lubrication circuit of the motor vehicle, the oil lubrication circuit has an oil pump which may be controlled by characteristic map. In this manner, an increase in the pressure in the cooling system may be designed in a flexible manner and to be dependent on operating parameters of the internal combustion engine, for example the current operating load point thereof, and/or driving parameters of the motor vehicle, for example a driving speed.

BRIEF DESCRIPTION OF THE FIGURES

FIG. 10 is a table having typical pressure values in a charged air intake region of the internal combustion engine according to FIG. 2 according to an operating load point of the internal combustion engine and a driving speed of the motor vehicle.

DETAILED DESCRIPTION

Figure 1:
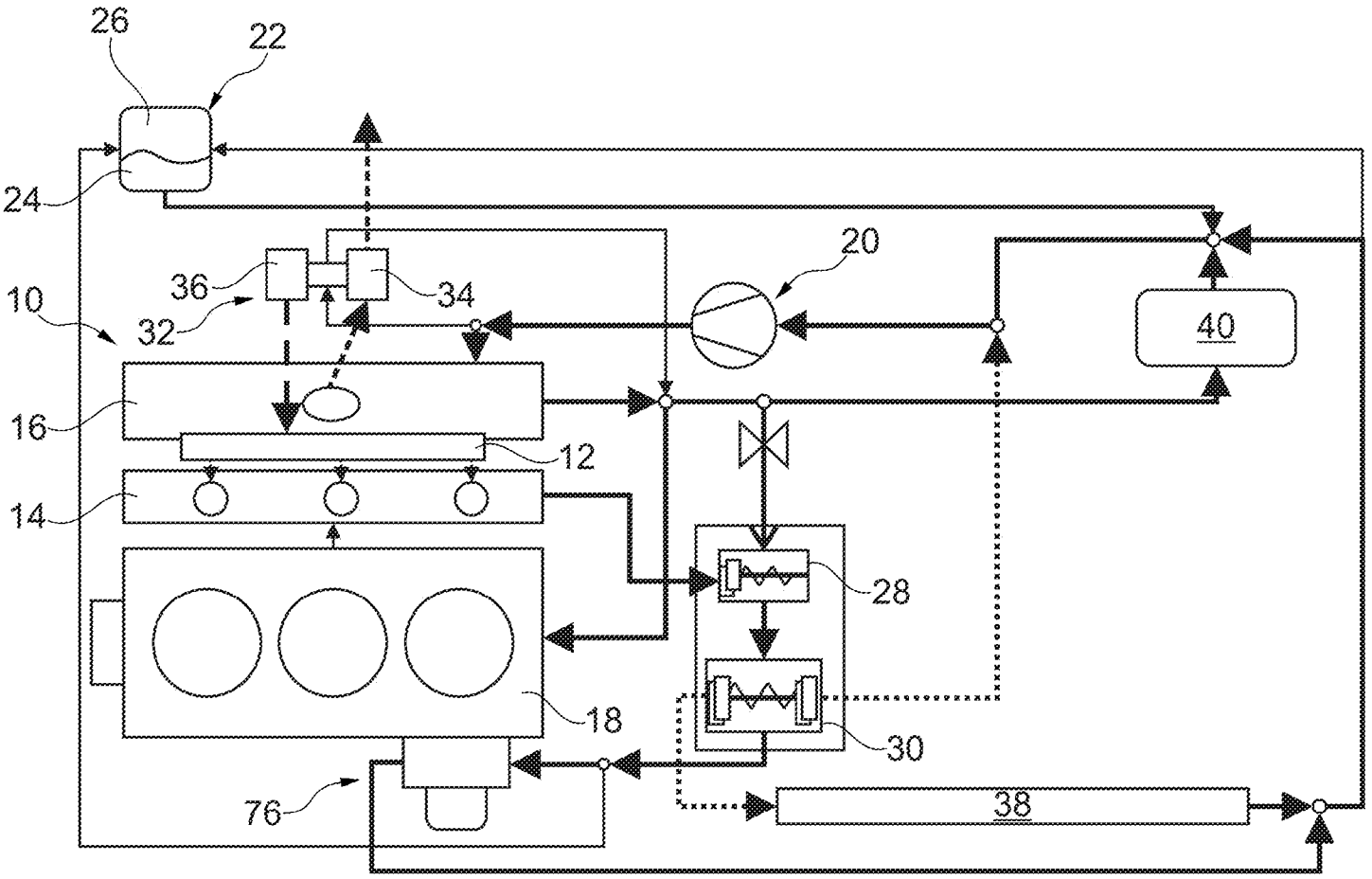
FIG. 1 is a schematic view of a conventional cooling system of an internal combustion engine of a motor vehicle, having "split cooling".
Figure 11:
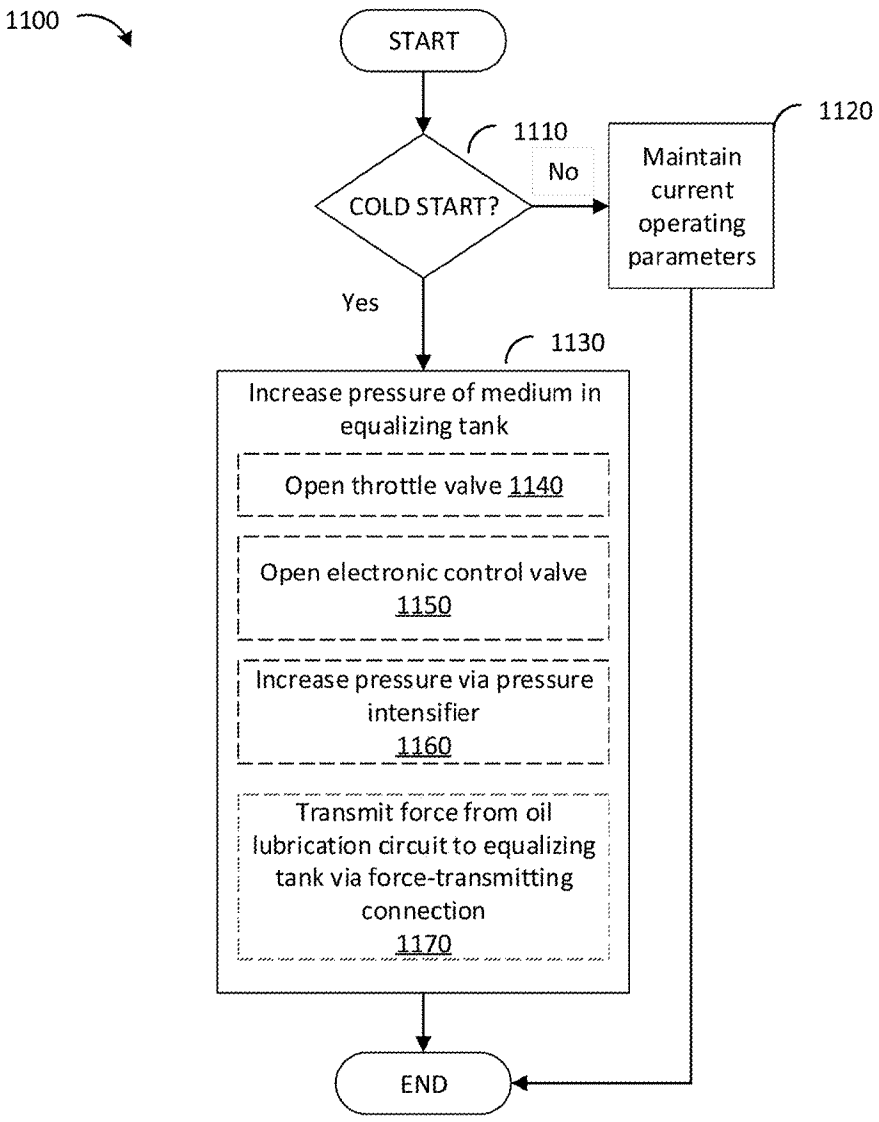
FIG. 11 is a flow chart of a method for regulating pressure in an equalizing tank.

The following description relates to systems and methods for regulating cavitation in the cooling system of an internal combustion engine of a motor vehicle. FIG. 1 is a schematic view of a conventional cooling system of an internal combustion engine 10 of a motor vehicle, having a "split cooling" concept. FIGS. 2 through 8 are schematic views of exemplary embodiments of cooling systems of the disclosure with relative positioning of the various components. FIG. 9 includes a characteristic map of a characteristic-map control of the oil pump of FIG. 8. FIG. 10 is a table of typical pressure values in a charged air intake region of the internal combustion engine according to FIG. 2. FIG. 11 is a flow chart of a method of regulating pressure in a coolant system according to some of the embodiments disclosed herein.

If shown directly contacting each other, or directly coupled, then the various components of the figures may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space there-between and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. In the different drawings, like parts are provided with the same reference numbers, as a result of which said parts are generally also described only once.

The cooling system contains a predetermined amount of coolant 24. The coolant may be any type of coolant generally used. In exemplary embodiments, the coolant is a water/glycol mixture (typically ≥40% glycol). The cooling system may additionally comprise a liquid/gas heat exchanger 38, which is arranged on a front side of the motor vehicle in a known manner and is commonly also referred to as a "cooler". Two coolant-temperature-dependent control elements 28, 30 of the cooling system, for example, thermostatic valves, represent fluidic connections between the various components of the cooling system depending on a temperature of the coolant 24. The cooling system may further include an equalizing tank 22, for receiving some of the coolant 24 in a coolant-temperature-dependent manner, and a coolant pump 20. The cooling system may additionally contain a plurality of connecting elements such as pipelines and tubes for producing fluidic connections.

The cooling system may additionally include another liquid/gas heat exchanger 40 of a cab heater which is provided to release heat in a passenger compartment of the motor vehicle.

The internal combustion engine 10 of the motor vehicle may be equipped with a turbocharger 32. A drive turbine 34 of the turbocharger 32 is driven in a known manner by an exhaust gas flow of the internal combustion engine 10. As a result, the drive turbine 34 moves a compressor 36 arranged on the same axle, which supplies air having an increased pressure by comparison with the external air pressure to an air intake region 12 of the internal combustion engine 10. Typical pressure values are indicated in the table of FIG. 10 according to an operating load point of the internal combustion engine 10 (rpm, top row) and a driving speed of the motor vehicle (km/h, first column).

The internal combustion engine 10 contains a cylinder head having a cylinder-head cooling-jacket part 14 on the inlet side and a cylinder-head cooling-jacket part 16 on the exhaust side fluidically separated therefrom inside the internal combustion engine 10. The internal combustion engine 10 also has an engine block having an engine-block cooling jacket 18, which is fluidically separated from the cylinder-head cooling-jacket parts 14, 16 inside the internal combustion engine 10.

The predetermined amount of coolant 24 is measured in such a way that, in the case of cold coolant 24, that is to say which is at the outside temperature, approximately half of the equalizing tank 22 is filled with coolant 24, and the space arranged thereabove is filled with air 26, the pressure of which corresponds to the normal atmospheric pressure plus the partial pressure of the coolant 24 (referred to in the following as normal atmospheric pressure for short).

During a start-up phase of the internal combustion engine 10 of the motor vehicle with cold coolant 24, the two thermostatic valves 28, 30 are closed, and the coolant pump 20 conveys the coolant 24 along a first cooling circuit which contains the cylinder-head coolant part 16 on the exhaust side and the liquid/gas heat exchanger 40 of the cab heater.

When the coolant temperature increases, the first thermostatic valve 28 firstly opens, and the coolant pump 20 conveys the coolant 24 in addition to the first cooling circuit through the engine-block cooling jacket 18, the cylinder-head coolant part 14 on the inlet side and a cooling-jacket part of an oil-filter/oil-cooler assembly 76 which is part of an oil lubrication circuit (not shown in greater detail in FIG. 1). The equalizing tank 22 is fluidically connected to the small cooling circuit on a lower face.

When the coolant temperature increases further, the second thermostatic valve 30 also opens. The coolant pump 20 then conveys the coolant 24 along a large cooling circuit, that is to say through the cylinder-head coolant part 16 on the exhaust side, the engine-block cooling jacket 18, the cylinder-head coolant part 14 on the inlet side and the cooler 38 back to the coolant pump 20, the cooling-jacket part of the oil-filter/oil-cooler assembly 76 being flowed through in a secondary flow.

In the case of a maximum coolant temperature, a maximum pressure in the equalizing tank 22 is approximately 1.4 bar (rel.).

Figure 2:
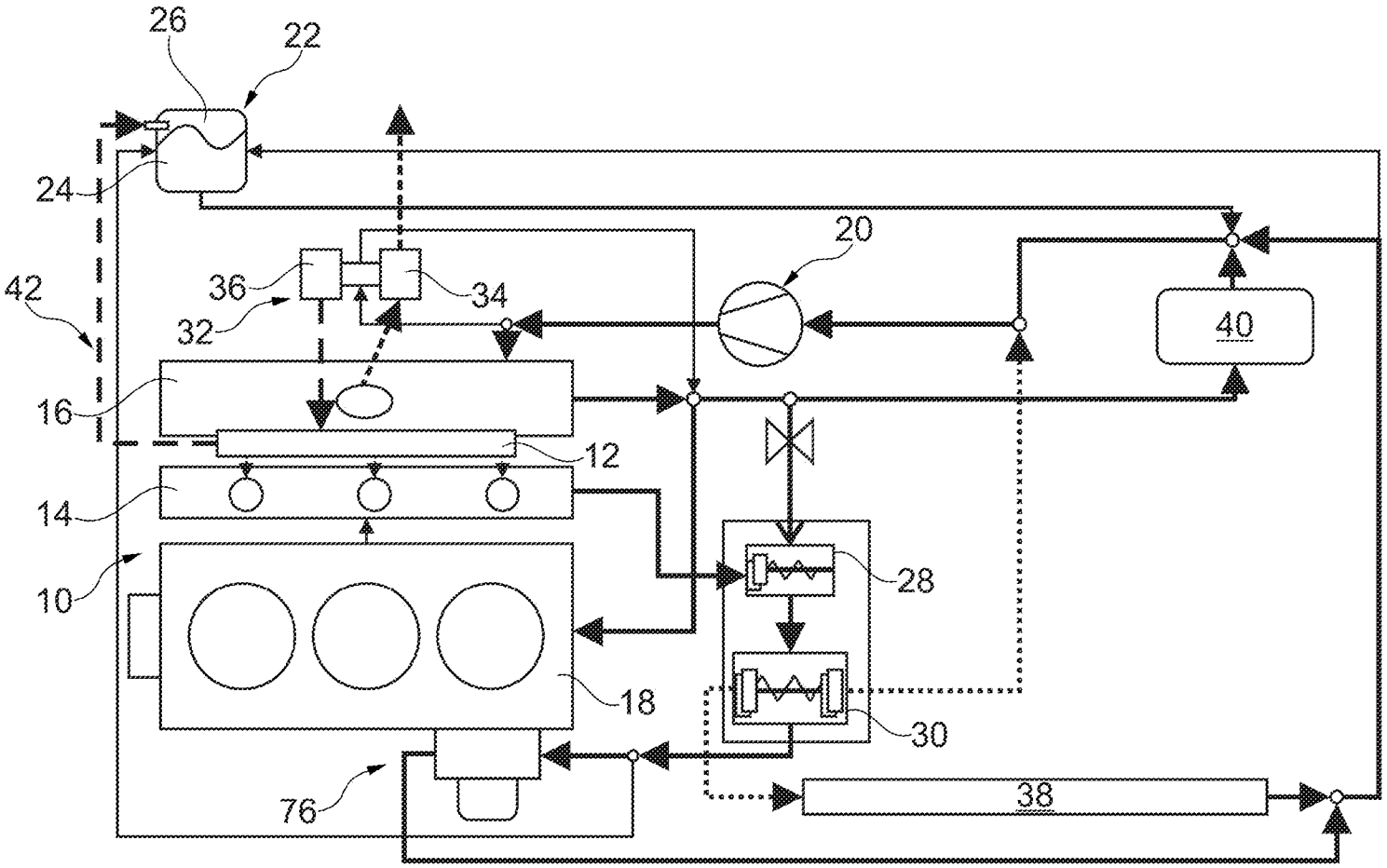
FIG. 2 is a schematic view of an embodiment of a cooling system according to the disclosure of an internal combustion engine of a motor vehicle, having "split cooling".

FIG. 2 is a schematic view of one possible embodiment of a cooling system according to the disclosure of an internal combustion engine 10 of a motor vehicle, which is constructed according to the "split cooling" concept. The cooling system according to the disclosure, the internal combustion engine 10 and the motor vehicle correspond to the embodiment according to the prior art, shown in FIG. 1, except for the differences which will be described in the following.

In the cooling system according to the disclosure as shown in FIG. 2, a direct fluidic connection 42 is set up between a medium in the equalizing tank 22, which medium is formed by the air 26 under normal atmospheric pressure over the coolant 24, and a medium of another media path of the motor vehicle, the media path formed by the air intake region 12 which is charged by the turbocharger 32, and the medium formed by the charged air in the air intake region 12.

In the case of a start-up and in particular a cold start of the internal combustion engine 10, a partial air-flow from the air intake region 12 of the internal combustion engine 10 is conducted into the air space of the equalizing tank 22, as a result of which the increased pressure of the air intake region 12 is transmitted to the cooling system and in particular to the coolant 24.

Figure 3:
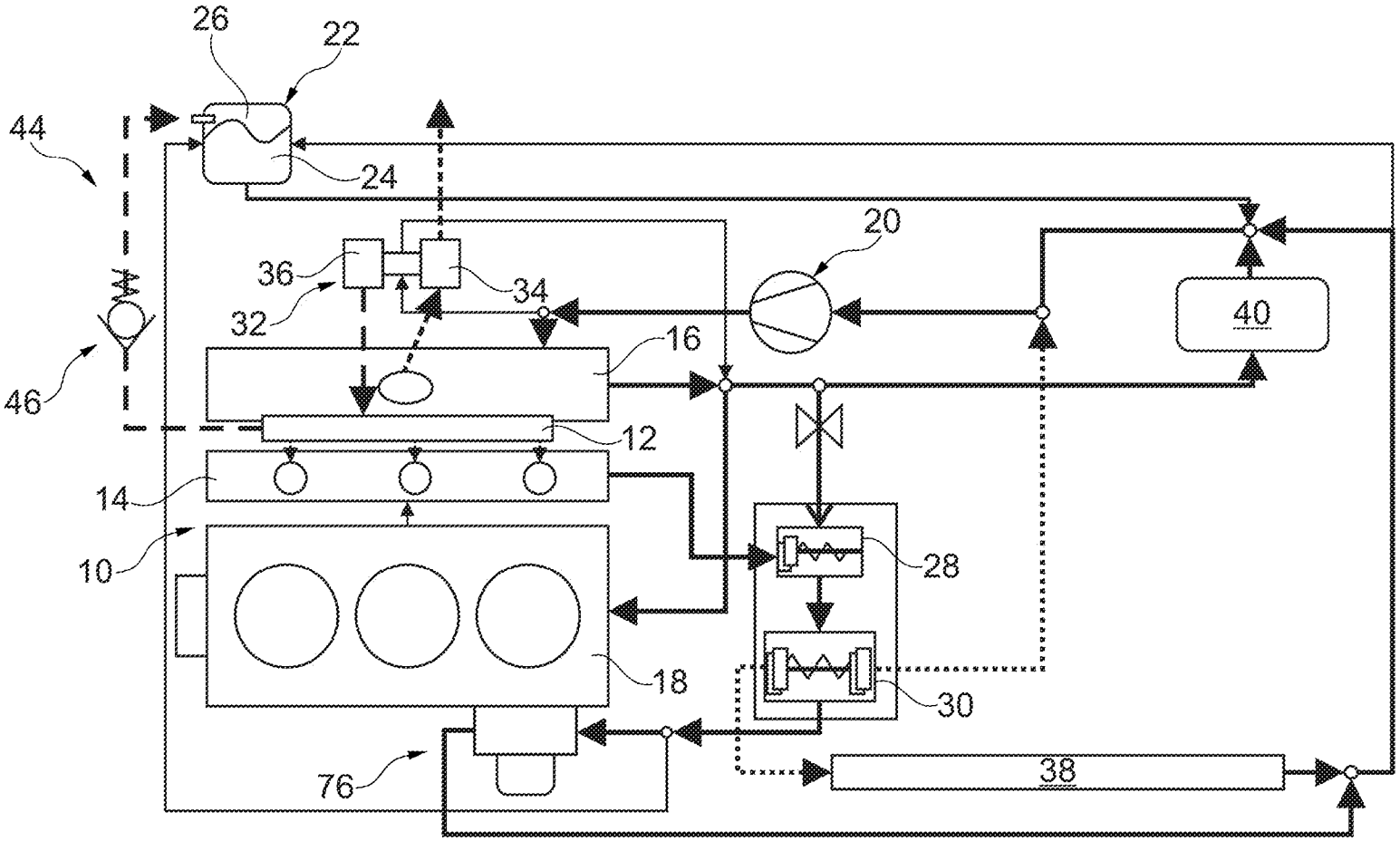
FIG. 3 is a schematic view of an embodiment of the cooling system according to FIG. 2, comprising an alternative fluidic connection between a medium in the equalizing tank and a medium of another media path.

FIG. 3 is a schematic view of an embodiment of the cooling system according to FIG. 2, comprising an alternative fluidic, activation-dependent connection 44 between the medium (air 26) in the equalizing tank 22 and the medium of another media path, which is formed by the air intake region 12 charged by the turbocharger 32.

The activation-dependent, fluidic connection 44 between the air 26 in the equalizing tank 22 and the air intake region 12 of the internal combustion engine 10 contains an activatable non-return valve 46 which is permeable in the direction of the equalizing tank 22. The non-return valve 46 can be in the form of a spring-loaded non-return valve. The non-return valve 46 is activated, and thus the fluidic connection 44 is produced, in that the pressure of the charged air intake region 12 exceeds a threshold for the pressure which is predetermined by the force of the spring-loading of the non-return valve 46. If the pressure of the charged air intake region 12 falls below the threshold, then the non-return valve 46 closes, and the increased pressure in the coolant 24 of the cooling system is maintained. In some aspects, the threshold is 2 bar. In other aspects, the pressure may be maintained between about 1.5 to 2 bar or any fraction thereof, wherein about is ±5%.

Figure 4:
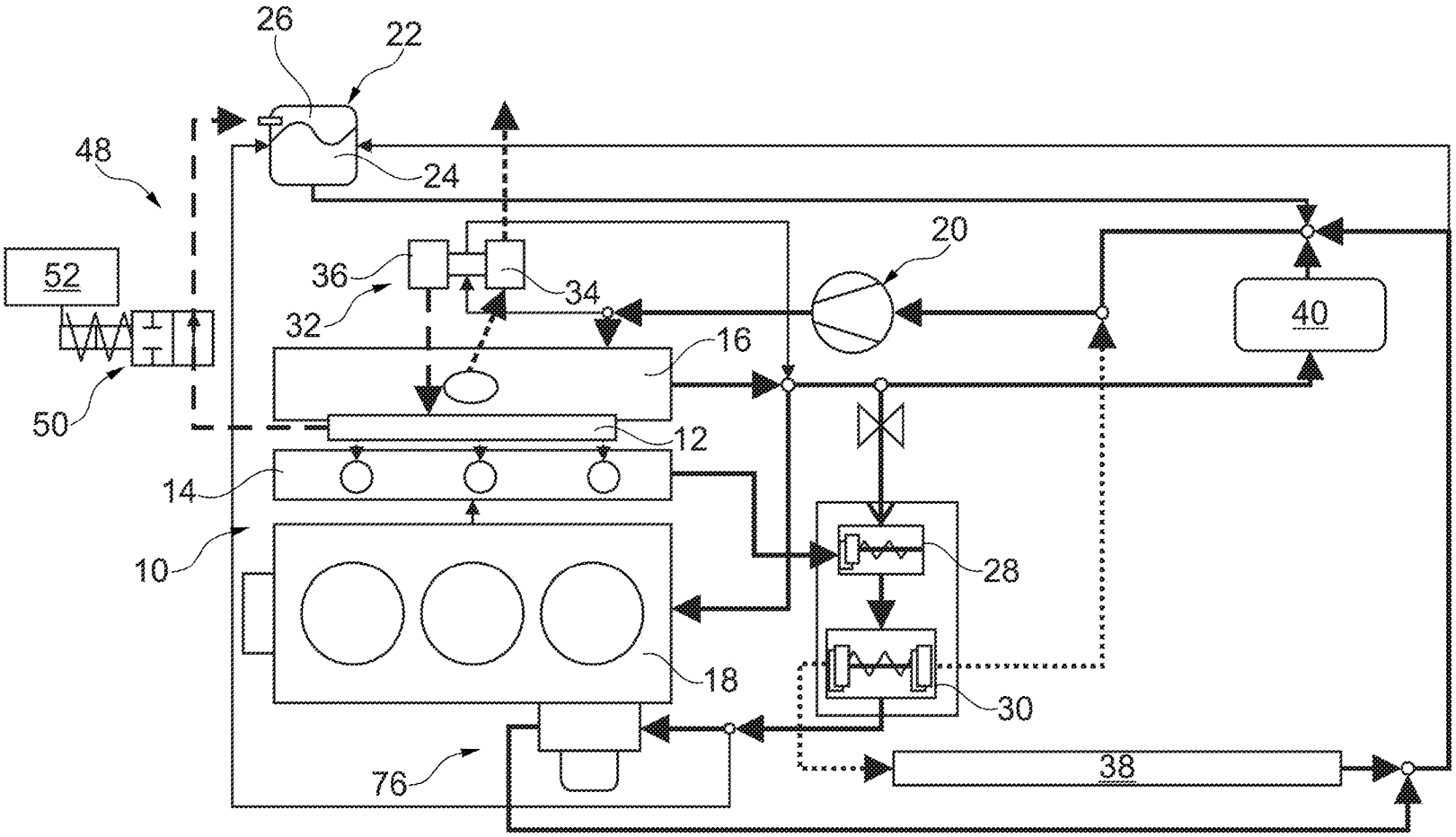
FIG. 4 is a schematic view of an embodiment of the cooling system according to FIG. 2, comprising another alternative fluidic connection.

FIG. 4 is a schematic view of an embodiment of the cooling system of FIG. 2, comprising another alternative fluidic, activation-dependent connection 48 between the medium (air 26) in the equalizing tank 22 and the medium of another media path, which is formed by the air intake region 12 charged by the turbocharger 32.

The activation-dependent, fluidic connection 48 between the air 26 in the equalizing tank 22 and the air intake region 12 of the internal combustion engine 10 contains an electrically controllable valve 50, which can be in the form of a three-way valve. An activation and thus the production of the fluidic connection 48 takes place by a corresponding control of the valve 50 by, for example, an electronic control unit 52. The electronic control unit 52 can be provided for example to receive data from an engine control unit of the motor vehicle (not shown) which relate to a current operating state of the turbocharger 32. In this manner, the fluidic connection 48 between the air 26 in the equalizing tank 22 and the air intake region 12 of the internal combustion engine 10 can be produced by controlling the valve 50 for example in the case of a desired charging-air pressure in the air intake region 12.

The control methods and routines disclosed herein such as those for control of the electrically controllable valves, may be stored as executable instructions in non-transitory memory and may be carried out by the control system including the electronic control unit 52 in combination with various sensors, actuators, and other engine hardware. Various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the control unit, where the described actions are carried out by executing the instructions in a system including the various engine and/or coolant system hardware components in combination with the control unit.

Figure 5:
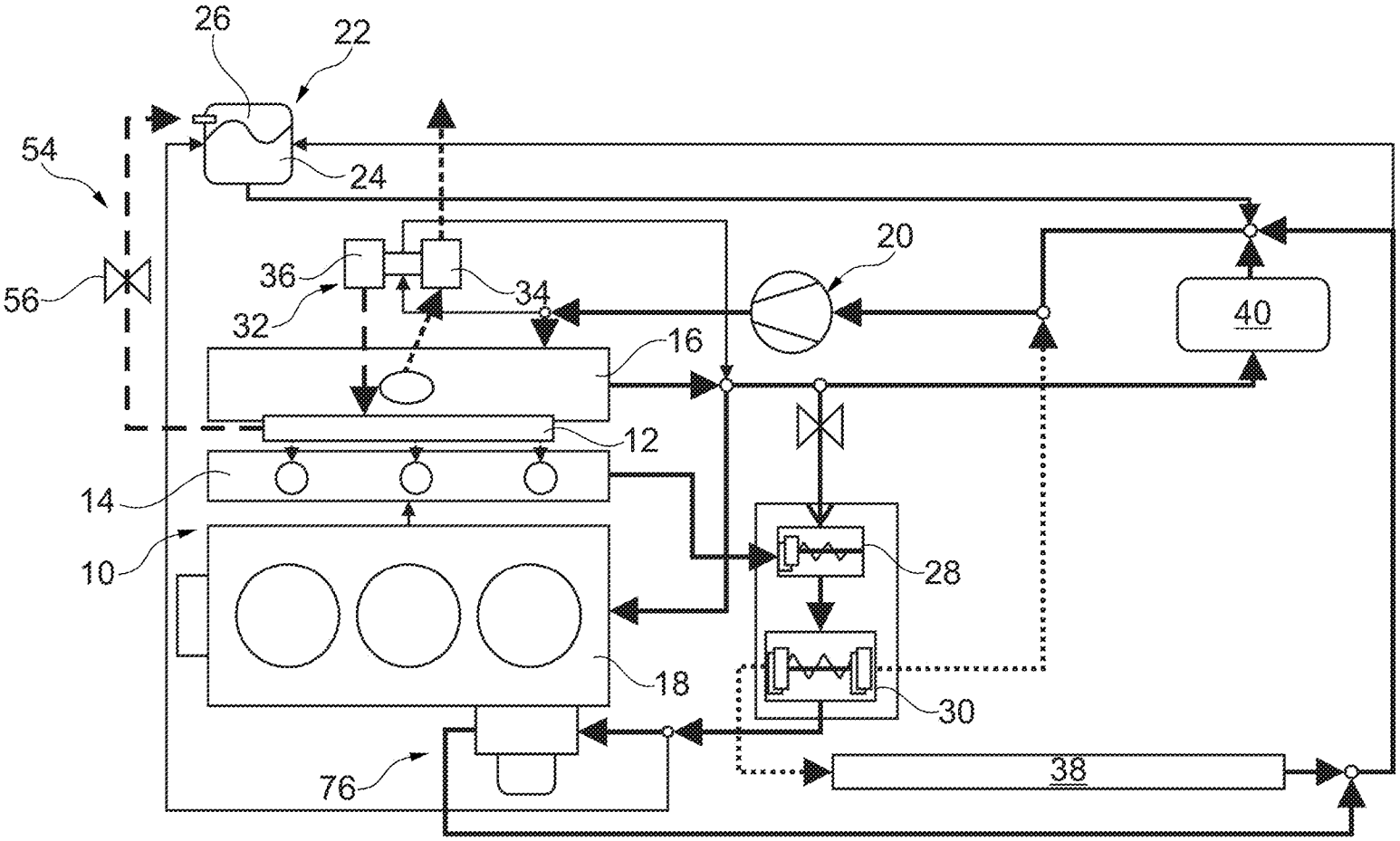
FIG. 5 is a schematic view of an embodiment of the cooling system according to FIG. 2, comprising another alternative fluidic connection.

FIG. 5 is a schematic view of an embodiment of the cooling system of FIG. 2, comprising an alternative direct, fluidic connection 54 between the medium (air 26) in the equalizing tank 22 and the medium of another media path, which is formed by the air intake region 12 charged by the turbocharger 32.

The direct, fluidic connection 54 between the air 26 in the equalizing tank 22 and the air intake region 12 of the internal combustion engine 10 contains a throttle valve 56 for flow restriction, by which the amount of air which is conducted from the air intake region 12 into the equalizing tank 22 can be controlled.

Figure 6:
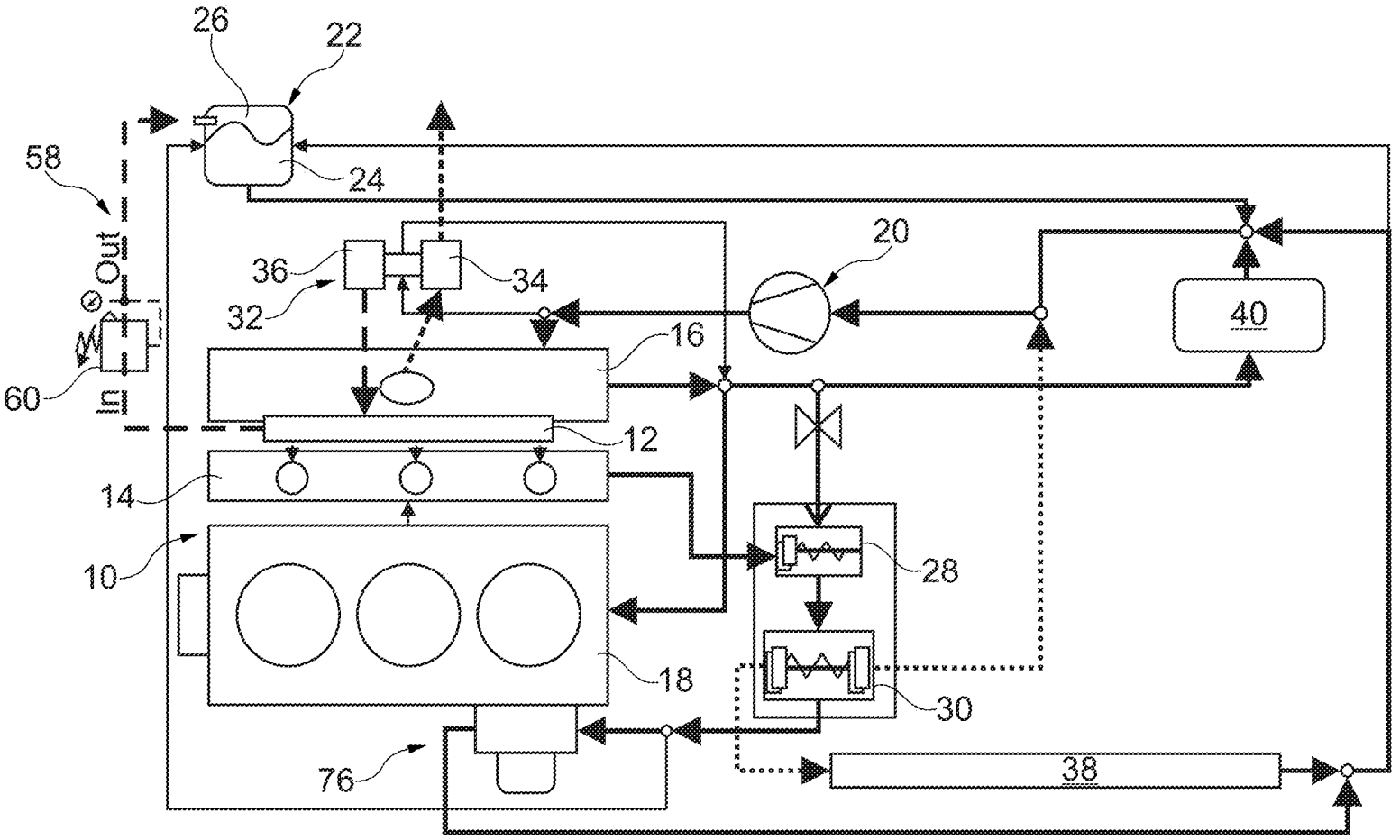
FIG. 6 is a schematic view of an embodiment of the cooling system according to FIG. 2, comprising a force-transmitting connection between a medium in the equalizing tank and a medium of another media path.

FIG. 6 is a schematic view of an embodiment of the cooling system of FIG. 2, comprising another alternative, direct, fluidic connection 58 between the medium (air 26) in the equalizing tank 22 and the medium of another media path, which is formed by the air intake region 12 charged by the turbocharger 32.

The direct, fluidic connection 58 between the air 26 in the equalizing tank 22 and the air intake region 12 of the internal combustion engine 10 contains a pressure-control valve 60 to limit the pressure in the equalizing tank 22. The control pressure of the pressure-control valve 60 is selected in such a way that a pressure-relief valve (not shown) which is conventionally set up on an upper face of the equalizing tank 22 does not respond.

Figure 7:
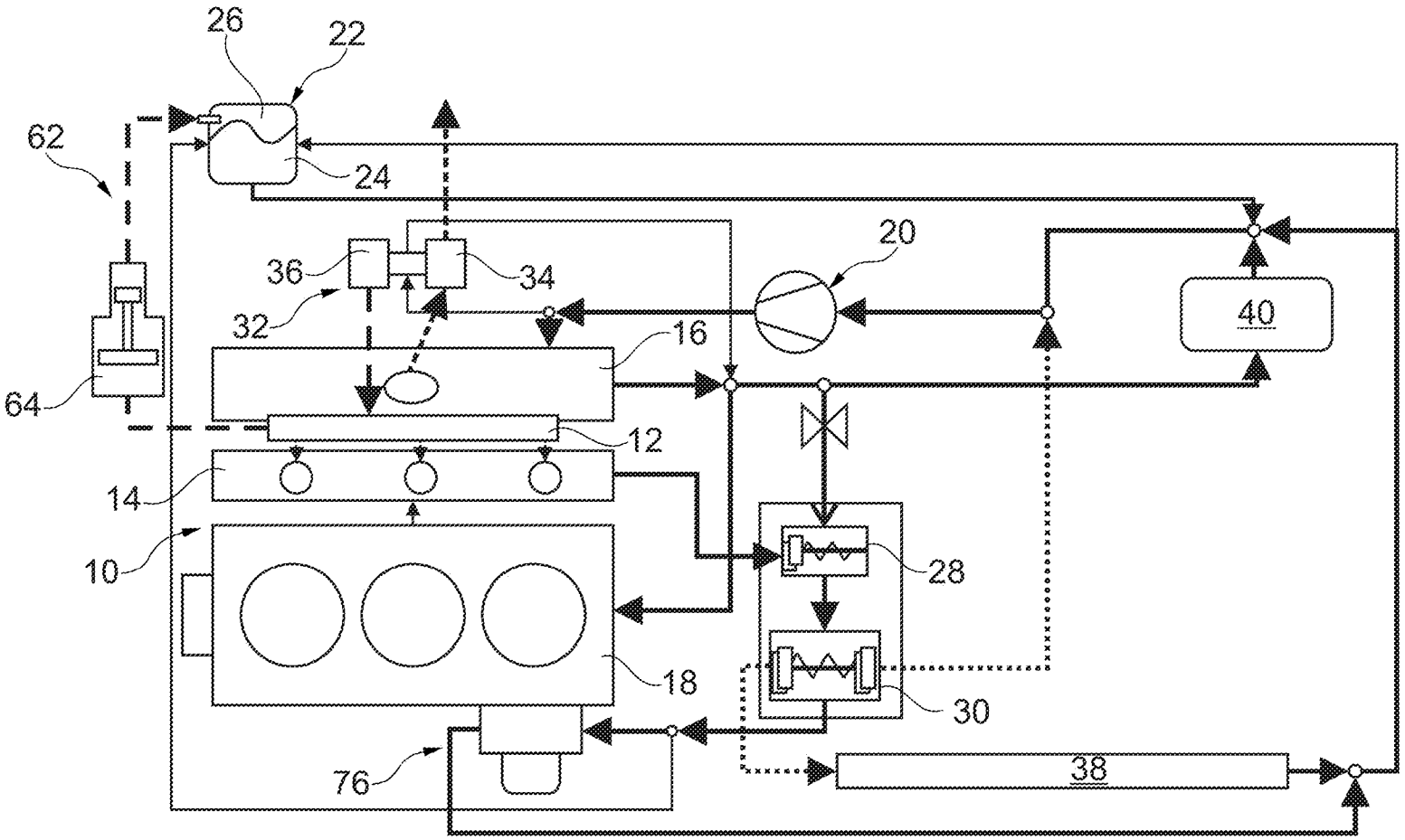
FIG. 7 is a schematic view of an embodiment of the cooling system according to FIG. 2, comprising a force-transmitting connection between a medium in the equalizing tank and a medium of another media path.

FIG. 7 is a schematic view of an embodiment of the cooling system of FIG. 2, comprising a force-transmitting connection 62 between the medium (air 26) in the equalizing tank 22 and the medium of another media path, which is formed by the air intake region 12 charged by the turbocharger 32.

The force-transmitting connection 62 between the air 26 in the equalizing tank 22 and the air intake region 12 of the internal combustion engine 10 contains a pressure intensifier 64 for increasing pressure. Using the pressure intensifier 64, an increased pressure by comparison with the air intake region 12 of the internal combustion engine 10 is achieved in the equalizing tank 22. Pressure intensifiers are known in the prior art and therefore do not need to be described in greater detail here.

Although the various embodiments of the fluidic or force-transmitting connection between the medium (air 26) in the equalizing tank 22 and the medium of another media path which is formed by the air intake region 12 charged by the turbocharger 32 are shown and described in isolation, said embodiments can also be combined with one another in an expedient manner. For example, it can be expedient to combine the electrically controllable valve 50 of the cooling system according to FIG. 4 with the activatable non-return valve 46 of the cooling system according to FIG. 3. Further combinations will expediently be put together by a person skilled in the art according to requirements.

Figure 8:
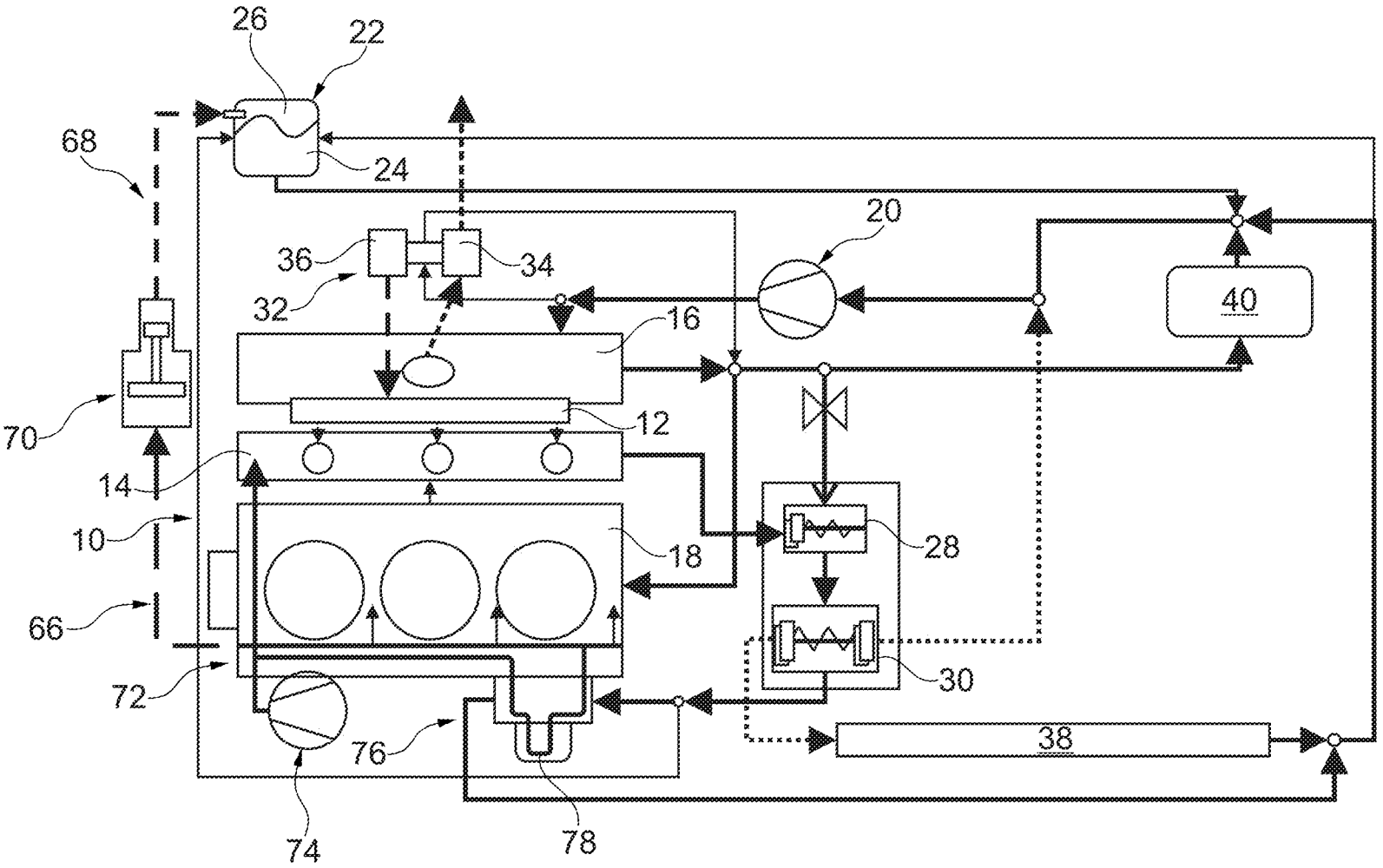
FIG. 8 is a schematic view of an embodiment of the cooling system according to FIG. 7, comprising a force-transmitting connection between a medium in the equalizing tank and a medium of another media circuit.
Figure 9:
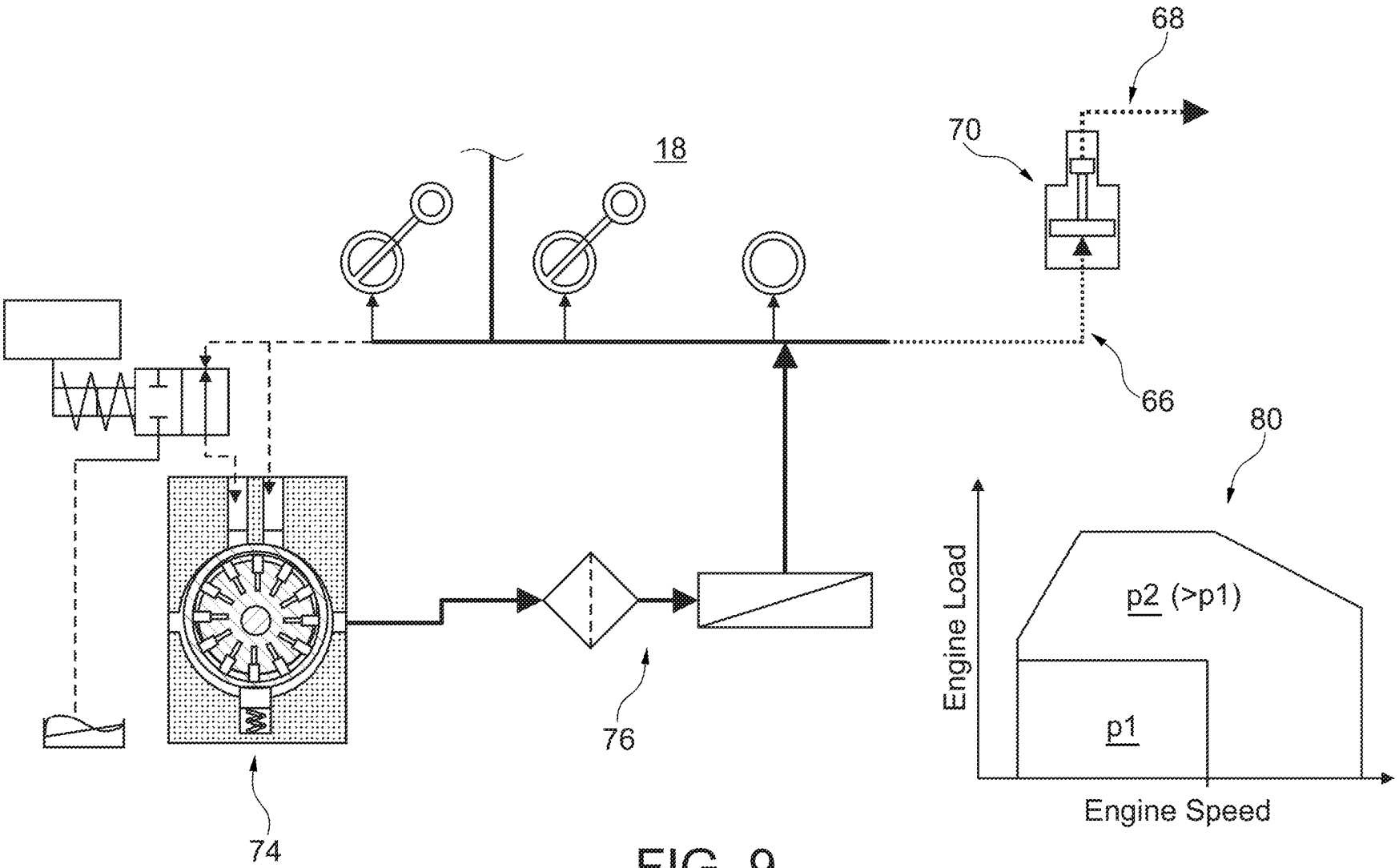
FIG. 9 is a schematic view of a detail of the cooling system according to FIG. 8.

FIG. 8 is a schematic view of an embodiment of the cooling system of FIG. 2, comprising a force-transmitting connection 66 between the medium in the equalizing tank 22, which medium is formed by the air 26 under normal atmospheric pressure over the coolant 24, and a medium of another media circuit of the motor vehicle, the media circuit being formed by an oil lubrication circuit 72 of the motor vehicle, and the medium being formed by the lubricating oil 78 circulating in the oil lubrication circuit 72.

The force-transmitting connection 66 between the air 26 in the equalizing tank 22 and the lubricating oil 78 of the oil lubrication circuit 72 contains a pressure-transmission element 70 having media separation. In an alternative embodiment, the pressure-transmission element can be replaced by a fluid separator having a movable dividing wall or having a membrane.

The oil lubrication circuit 72 contains an oil pump 74 which can be controlled by a characteristic map for circulating the lubricating oil 78 (FIG. 9). During operation of the oil pump 74, an operating pressure of the lubricating oil 78 is present at an output of the oil-filter/oil-cooler assembly 76, which pressure is transmitted to one side of the pressure-transmission element 70 by a line filled with lubricating oil. On the other side of the pressure-transmission element 70 facing away from the lubricating oil side, a direct, fluidic connection 68 to the air 26 in the equalizing tank 22 is set up.

FIG. 9 contains an example of a characteristic map 80 of a characteristic-map control of the oil pump 74. Using the characteristic-map control, the oil pump 74 is provided to build up, according to an operating parameter of the internal combustion engine 10, namely the current operating load point thereof, and a driving parameter of the motor vehicle 10, namely the driving speed thereof, one of two predetermined operating pressure values p1, p2 for the lubricating oil at the output of the oil-filter/oil-cooler assembly 76.

FIG. 11 is a flow chart of a method 1100 for regulating pressure in a coolant system of an internal combustion engine of a motor vehicle. Instructions for carrying out method 1100 and the rest of the methods included herein may be executed by a control unit based on instructions stored on a memory of the control unit and in conjunction with signals received from sensors of the engine system, such as the intake pressure sensor positioned at an intake line or at the intake manifold or a temperature sensor in the coolant line. The control unit may employ engine actuators of the engine system to adjust engine operation, according to the methods described below.

When starting an engine with cold coolant, such as during a cold start, the pressure in the cooling system substantially corresponds to the normal atmospheric pressure. At 1110, method 1100 determines whether or not the engine is being cold started. In one example, method 1100 may determine the state of engine operating parameters to determine if the engine is being cold started. For example, if engine coolant temperature, as measured by the temperature sensor in the coolant line, is below a threshold temperature, it may be determined that the engine is experiencing a cold start. In the event that it is determined that the engine is not experiencing a cold start, the method proceeds to 1120 at which point current operating parameters are maintained. As used herein, maintaining current operating parameters may include maintaining a throttle valve (e.g. valve 56) or electronic control valve (e.g. valve 50) closed. However, in other examples, maintaining current operating parameters may include supplying pressure to the equalizing tank regardless of operating conditions.

If it is determined at 1110 that the engine is experiencing a cold start, the method proceeds to 1130 and the pressure of the medium is increased. In exemplary aspects, the medium is formed by the air 26 under normal atmospheric pressure over the coolant 24. The pressure of the medium may be increased in a variety of ways including direct fluidic connection, one or more activation dependent fluidic connections, and/or one or more force-transmitting connections. Such methods may be used alone or in any combination. In some aspects, the pressure of the medium may be continuously maintained. For example, in some aspects, as shown in FIG. 2, the medium in the equalizing tank 22 is set up in direct fluidic connection with medium of another media path such as the media path formed by the air intake region 12 which is charged by the turbocharger 32. Thus, the increased pressure of the air intake region 12 is transmitted to the cooling system. In some aspects, when the threshold pressure is reached, the equalizing tank 22 may maintain the pressure by releasing excess pressure through a release valve. In additional aspects, increasing the pressure of the medium may include the use of a non-return valve such as non-return valve 46 as shown in the fluidic connection 44 of FIG. 3. When the pressure of the charged air intake region 12 exceeds a threshold for the pressure as determined by the force of the non-return valve, the valve opens, increasing the pressure of the medium. In further aspects, as in step 1140, the connection between the equalizing tank 22 and the air intake region 12 may be regulated by a throttle valve as in FIG. 5. In other aspects, alone or in combination with direct connection, additional activation dependent fluidic connections and one or more force-transmitting connections, an electronic control valve 1150 such as the pressure-control valve shown in FIG. 6 may be used to regulate the fluidic connection 58 between the medium in the equalizing tank 22 and the medium of another media path. In yet another aspect, such as that shown at step 1160, the pressure of the medium may be increased via a force-transmitting connection 62. The force-transmitting connection may include pressure intensifier as shown in FIG. 7. In some aspects, as shown at step 1170, a second force-transmitting connection 66, between the oil lubrication circuit 72 and a pressure-transmission element 70, may be used alone or in combination with other mechanisms to increase the pressure of the medium. In exemplary embodiments, the pressure-transmission element may have media separation. In further exemplary embodiments, the pressure-transmission element can be replaced by a fluid separator having a movable dividing wall or a membrane. Once the pressure reaches the appropriate threshold, the method 1100 ends.

In examples where a controllable valve is included in the fluidic connection, e.g. as in FIGS. 4 and 5, the valve may be opened when intake pressure is higher than a threshold, for example higher than atmospheric pressure, and may be closed when intake pressure is lower than that threshold. In this way, air may be provided to the equalizing tank when air is higher than atmospheric pressure and may be prevented from back flowing into the intake manifold under low manifold pressure conditions.

Although the embodiments of the cooling system described herein show at least one direct or at least one activation-dependent, fluidic connection, or at least one force-transmitting connection between a medium in the equalizing tank and in each case one other media path or media circuit of the motor vehicle, it is within the scope of the disclosure that such connections are set up to more than one other media path or media circuit of the motor vehicle, for example to the air intake region of the internal combustion engine and the oil lubrication circuit of the motor vehicle.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

LIST OF REFERENCE SIGNS

10 internal combustion engine
12 air intake region
14 cylinder-head cooling-jacket part on the inlet side
16 cylinder-head cooling-jacket part on the exhaust side
18 engine-block cooling jacket
20 coolant pump
22 equalizing tank
24 coolant
26 air
28 control element
30 control element
32 turbocharger
34 drive turbine
36 compressor
38 liquid/gas heat exchanger
40 liquid/gas heat exchanger (heater)
42 fluidic connection
44 fluidic connection
46 activatable non-return valve
48 fluidic connection
50 electrically controllable valve
52 electronic control unit
54 fluidic connection

LIST OF REFERENCE SIGNS (CONT.)

56 throttle valve
58 fluidic connection
60 pressure-control valve
62 force-transmitting connection
64 pressure intensifier
66 force-transmitting connection
68 fluidic connection
70 pressure-transmission element
72 oil lubrication circuit
74 oil pump
76 oil-filter/oil-cooler assembly
78 lubricating oil
80 characteristic map
p1 pressure value
p2 pressure value

The invention claimed is:

1. A cooling system of an internal combustion engine of a motor vehicle, the cooling system comprising:
- a predetermined amount of coolant,
- at least one liquid/gas heat exchanger,
- at least one coolant-temperature-dependent control element,
- an equalizing tank for receiving some of the coolant in a coolant-temperature-dependent manner,
- connecting elements for producing fluidic connections, and
- a coolant pump,
- wherein at least one direct or at least one activation-dependent fluidic connection or at least one force-transmitting connection is set up between a medium in the equalizing tank and a medium of at least one other media path or media circuit of the motor vehicle, and wherein the connection set up between the medium in the equalizing tank and the medium of the at least one other media path or media circuit contains a pressure-transmission element having media separation or a fluid separator having a movable dividing wall or having a membrane.

2. The cooling system as claimed in claim 1, wherein the at least one other media path or media circuit is formed by an air intake region of the internal combustion engine.

3. The cooling system as claimed in claim 1, wherein the at least one other media path or media circuit is formed by an oil lubrication circuit of the motor vehicle.

4. The cooling system as claimed in claim 3, wherein the oil lubrication circuit of the motor vehicle has an oil pump which can be controlled by a characteristic map.

5. The cooling system as claimed in claim 1, wherein the connection set up between the medium in the equalizing tank and the medium of the at least one other media path or media circuit contains an activatable non-return valve which is permeable in the direction of the equalizing tank.

6. The cooling system as claimed in claim 1, wherein the connection set up between the medium in the equalizing tank and the medium of the at least one other media path or media circuit contains an electrically controllable valve.

7. The cooling system as claimed in claim 1, wherein the connection set up between the medium in the equalizing tank and the medium of the at least one other media path or media circuit contains a throttle valve for flow restriction.

8. The cooling system as claimed in claim 1, wherein the connection set up between the medium in the equalizing tank and the medium of the at least one other media path or media circuit contains a pressure-control valve for limiting the pressure in the equalizing tank.

9. The cooling system as claimed in claim 1, wherein the connection set up between the medium in the equalizing tank and the medium of the at least one other media path or media circuit contains a pressure intensifier for increasing pressure.

10. A cooling system of an internal combustion engine of a motor vehicle, the cooling system comprising:

a predetermined amount of coolant, at least one liquid/gas heat exchanger, at least one coolant-temperature-dependent control element, an equalizing tank for receiving some of the coolant in a coolant-temperature-dependent manner, at least one force-transmitting connection, and a coolant pump, wherein, the at least one force-transmitting connection is set up between a medium in the equalizing tank and a medium of at least one other media path or media circuit of the motor vehicle; and wherein the force-transmitting connection set up between the medium in the equalizing tank and the medium of at least one other media path or media circuit contains a pressure intensifier for increasing pressure, and wherein the medium in the equalizing tank is formed by air under normal atmospheric pressure over the coolant and the medium of the at least one other media path or media circuit is lubricating oil circulating in an oil lubrication circuit.

11. The cooling system of claim 10, wherein the oil lubrication circuit comprises an oil pump controlled by a characteristic map.

12. The cooling system of claim 10, wherein the force-transmission connection comprises a fluid separator having a moveable dividing wall or membrane.

13. A cooling system of an internal combustion engine of a motor vehicle, the cooling system comprising:

a predetermined amount of coolant, at least one liquid/gas heat exchanger, at least one coolant-temperature-dependent control element, an equalizing tank for receiving some of the coolant in a coolant-temperature-dependent manner, at least one force-transmitting connection, and a coolant pump, wherein, the at least one force-transmitting connection is set up between a medium in the equalizing tank and a medium of at least one other media path or media circuit of the motor vehicle; and wherein the force-transmitting connection set up between the medium in the equalizing tank and the medium of at least one other media path or media circuit contains a pressure intensifier for increasing pressure, wherein the force-transmitting connection contains a pressure-transmission element having media separation or comprises a fluid separator having a moveable dividing wall or membrane.

14. The cooling system of claim 13, wherein pressure is transmitted to a first side of the pressure-transmission element by a line filled with lubricating oil.

15. The cooling system of claim 14, wherein a second side of the pressure-transmission element is in fluidic connection with air in the equalizing tank.

* * * * *